US005822862A

United States Patent [19]

Ferraro

[11] Patent Number: 5,822,862

[45] **Date of Patent: *Oct. 20, 1998**

[54] SUSPENDED BLADE SHAVING SYSTEM

[75] Inventor: Frank Anthony Ferraro, Trumbull, Conn.

[73] Assignee: Warner-Lambert Co., Morris Plains, N.J.

[ * ] Notice: The term of this patent shall not extend beyond the expiration date of Pat. No. 5,666,729.

[21] Appl. No.: 785,261

[22] Filed: Jan. 17, 1997

[51] Int. Cl.[6] ..... B26B 21/02

[52] U.S. Cl. ..... 30/50; 30/47

[58] Field of Search ..... 30/47, 48, 49, 30/50

[56] References Cited

U.S. PATENT DOCUMENTS

| | | | |
|---|---|---|---|
| 4,063,354 | 12/1977 | Oldroyd et al. | 30/47 |
| 4,069,580 | 1/1978 | Cartwright et al. | 30/47 |
| 4,200,976 | 5/1980 | Gooding | 30/47 |
| 4,403,412 | 9/1983 | Trotta | 30/47 |
| 4,516,320 | 5/1985 | Peleckis | 30/49 |
| 4,574,476 | 3/1986 | Ortiz | 30/47 |
| 4,868,983 | 9/1989 | Francis | 30/50 |
| 5,070,612 | 12/1991 | Abatemarco | 30/50 |
| 5,630,275 | 5/1997 | Wexler | 30/50 |
| 5,666,729 | 9/1997 | Ferraro | 30/50 |

*Primary Examiner*—Hwei-Siu Payer
*Attorney, Agent, or Firm*—Charles W. Almer, III

[57] ABSTRACT

Shaving systems having a first support, at least one, and preferably a plurality, of resilient supports, and a plurality of skin-engaging elements movably arranged in spaced relation and supported by the resilient support. The resilient supports normally maintain the movable skin-engaging elements, e.g. blades, guards, and/or cap member, in spaced relation such that the movable, skin-engaging elements are spaced by a first distance, relative to each other, when the skin-engaging elements are in a normal, unbiased position. In one embodiment, when one or more of the skin-engaging elements is acted upon by forces normally encountered during shaving, the resilient supports yield in order to move each of the blades and the cap into a more aggressive position.

37 Claims, 6 Drawing Sheets

SUSPENDED BLADE SHAVING SYSTEM

The present invention is directed to a shaving system and, more particularly, to a shaving system having at least one and preferably a plurality of movable skin-engaging elements connected to a support base.

BACKGROUND OF THE INVENTION

Relatively recent advances in shaving systems have included a variety of dynamic razors wherein one or more of a guard member, seat blade, and cap blade, move in response to forces encountered during shaving. Various systems which have been disclosed change the shaving angle of one or more of the blades, the span and/or the blade exposure in response to shaving forces.

One such system described in U.S. Pat. No. 4,586,255 to Jacobson comprises a movable guardbar, and two movable blades, all of which are spring loaded in a supporting structure for movement in response to forces encountered during shaving. The sharpened blades are welded to blade supports which contact upwardly biased leaf springs. The movable guard member and blades are maintained within the supporting structure by metal bands which wrap around the ends of the cartridge. When the movable blades encounter forces during shaving, the blades are urged downwardly into the support structure to less aggressive shaving positions in order to minimize the risk of causing nicks and cuts. In light of the welding steps and the number of separate pieces which must be assembled during the manufacture of this cartridge, it would be desirable to provide a dynamic shaving system which can be manufactured quickly and at relatively low cost.

Since the skin-engaging elements of the aforementioned system move independently, forces exerted on one skin-engaging element will not cause other skin-engaging elements to take less aggressive positions. It would therefore also be desirable to provide a shaving system wherein the position of more than one skin-engaging element will be changed by movement of a single skin-engaging element.

It would also be desirable to provide a shaving system which provides a safer shave than a conventional two-blade cartridge.

SUMMARY OF THE INVENTION

Various embodiments of the present invention comprise shaving systems having at least one, and preferably a plurality of, resilient supports, and a plurality of blades movably arranged in spaced relation and rigidly connected to the resilient supports.

One preferred embodiment of the present invention comprises a razor head having a support base and side walls. A plurality of resilient supports are disposed in spaced offset relation and are integrally molded with the support base. The supports rigidly connect three movable blades between upper and lower retention surfaces. The top blade or cap blade supports a movable cap member. The resilient supports normally maintain the movable blades and cap member in spaced relation such that the movable skin-engaging elements are spaced by a first distance, relative to each other, when the skin-engaging elements are in a normal, unbiased position. When one or more of the skin-engaging elements is acted upon by forces encountered during shaving, the resilient supports move each of the blades and the cap into a less aggressive, compressed position wherein the spacing between neighboring skin-engaging elements is reduced and the blades are moved downwardly into the space between the side walls. According to this preferred embodiment of the present invention, the blades are maintained in a substantially parallel relation when the shaving system is in its "normal" unbiased position. When one or more of the skin-engaging elements are acted upon by the forces encountered during shaving, the rearward portion of the blades is rotated slightly downwardly, the forward edges of the blades deflect downwardly thus creating a slight, temporary non-planar condition in the blade. It is believed that a relatively long cantileveral forward section of the blades and the offset relative position of the upper and lower retention surfaces holding the blades facilitates the deflection of the forward edges of the blades in response to such forces.

The provision of three blades is designed to increase the efficiency of the shave provided by one preferred embodiment of the present invention. Other embodiments comprise fewer blades, while still other embodiments comprise a fixed and/or segmented cap member.

These and other embodiments are described in greater detail below with reference to the figures.

DETAILED DESCRIPTION

The illustrated embodiment of the present invention is a shaving system in the form of a razor head comprising a support base with integrally molded, resilient supports which movably connect three sharpened blades and a movable cap member to the support base. While the present invention is illustrated in the form of a disposable cartridge, the advantages of the present invention are equally applicable to other razor heads and shaving systems. As used herein, the term "razor head" is meant to include cartridges which are designed and manufactured for attachment to a separate razor, as well as the operative portion of a disposable razor wherein the skin-engaging portions are integrally formed with a handle section.

Figure 3:
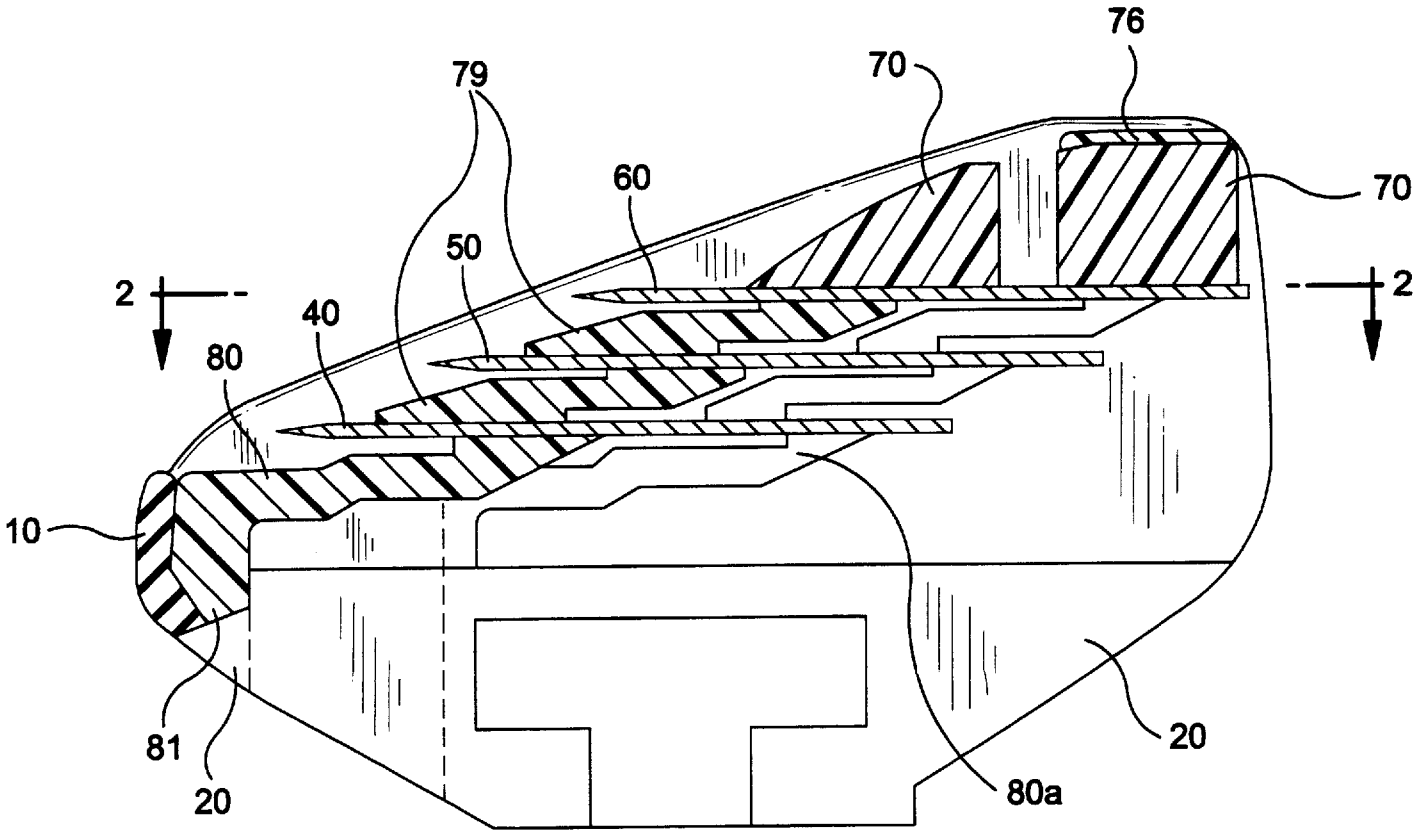
FIG. 3 is a cross-sectional view taken along lines 3—3 of FIG. 1.

The razor head illustrated in the Figures comprises a resilient skin-engaging surface 10 connected to a support base 20 having fixed side walls 30. A seat blade 40, middle blade 50, and cap blade 60 are movably supported by support members 80, 80*a* as best shown in FIG. 3. According to this preferred embodiment of the present invention, support members 80, 80*a* are integrally molded with base 20. The support members are rigidly connected to each of the blades with an upper retention surface 88 and a lower retention surface 89. A lower portion of at least one of the support members 80, 80*a* acts as a guard surface 81. In the illustrated embodiment, cap member 70 is segmented into six segments in order to eliminate distortion during post-molding shrinkage. The rearward illustrated segments also comprise shaving aid 76 disposed on cap blade 60.

Figure 1:
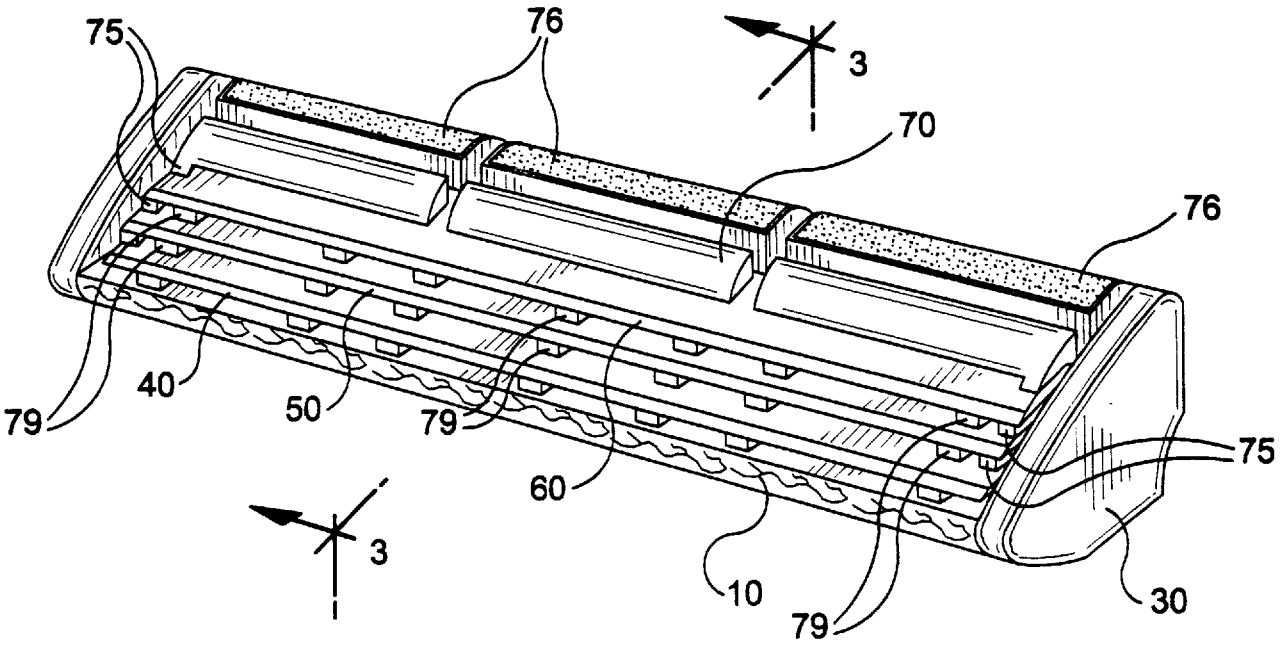
FIG. 1 is a top, perspective view of one embodiment of the present invention.

As shown in FIGS. 1 and 3, portions 79 of resilient support 80 positioned on the top of one blade advantageously extend more forwardly than the sharpened edge of the adjacent blade in order to engage the skin surface being shaved and act as a guard element and thereby facilitate greater control of the skin surface as it approaches a sharpened blade edge during shaving. As can be appreciated from the present disclosure, it is possible to manufacture the resilient support members 80, 80*a* or portions thereof, e.g., portion 79 from a single resilient material which has a higher or lower coefficient of friction than wet skin and/or it is possible to manufacture different portions of the resilient support members 80, 80*a* from different resilient materials having varying coefficients of friction.

Figure 2:
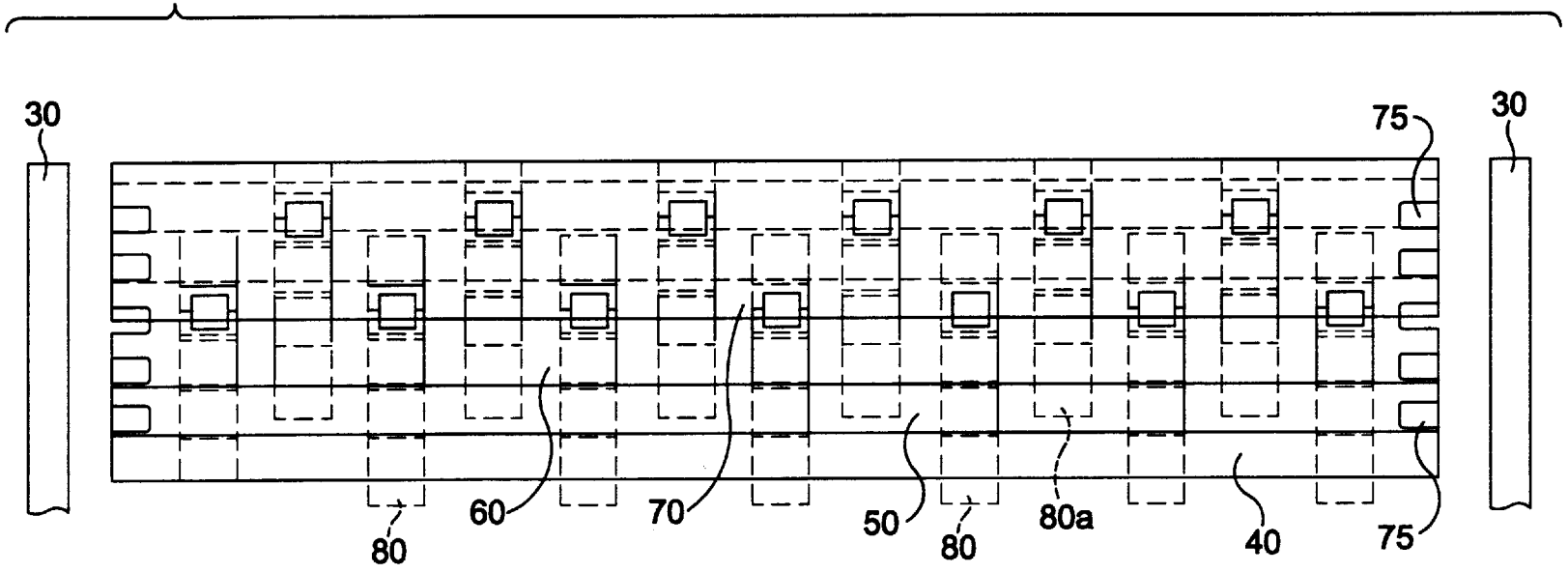
FIG. 2 is a partial, top view illustrating the relative positioning of the blades and supports of the razor head shown in FIG. 1.

While the number of resilient supports 80, 80*a* can be varied without departing from the scope of the present invention, as shown in FIG. 2 the illustrated embodiment has thirteen resilient supports. Adjacent resilient supports are disposed in offset relation such that a forwardly disposed resilient support 80 will be positioned next to rearwardly disposed resilient supports 80*a*. This offset positioning of resilient supports 80 is advantageously designed to increase the stability of the skin-engaging elements and also to provide greater flexibility in design as described below. In order to facilitate assembly of the blades within the cavity of a mold for insert molding, the blades are advantageously provided with positioning notches 75 in the sides thereof. The present invention is particularly suited to be manufactured by an insert molding process. As used herein, the term "insert molding" is used to indicate a molding operation wherein the product which leaves the mold is a final product and does not require further assembly.

Figure 4:
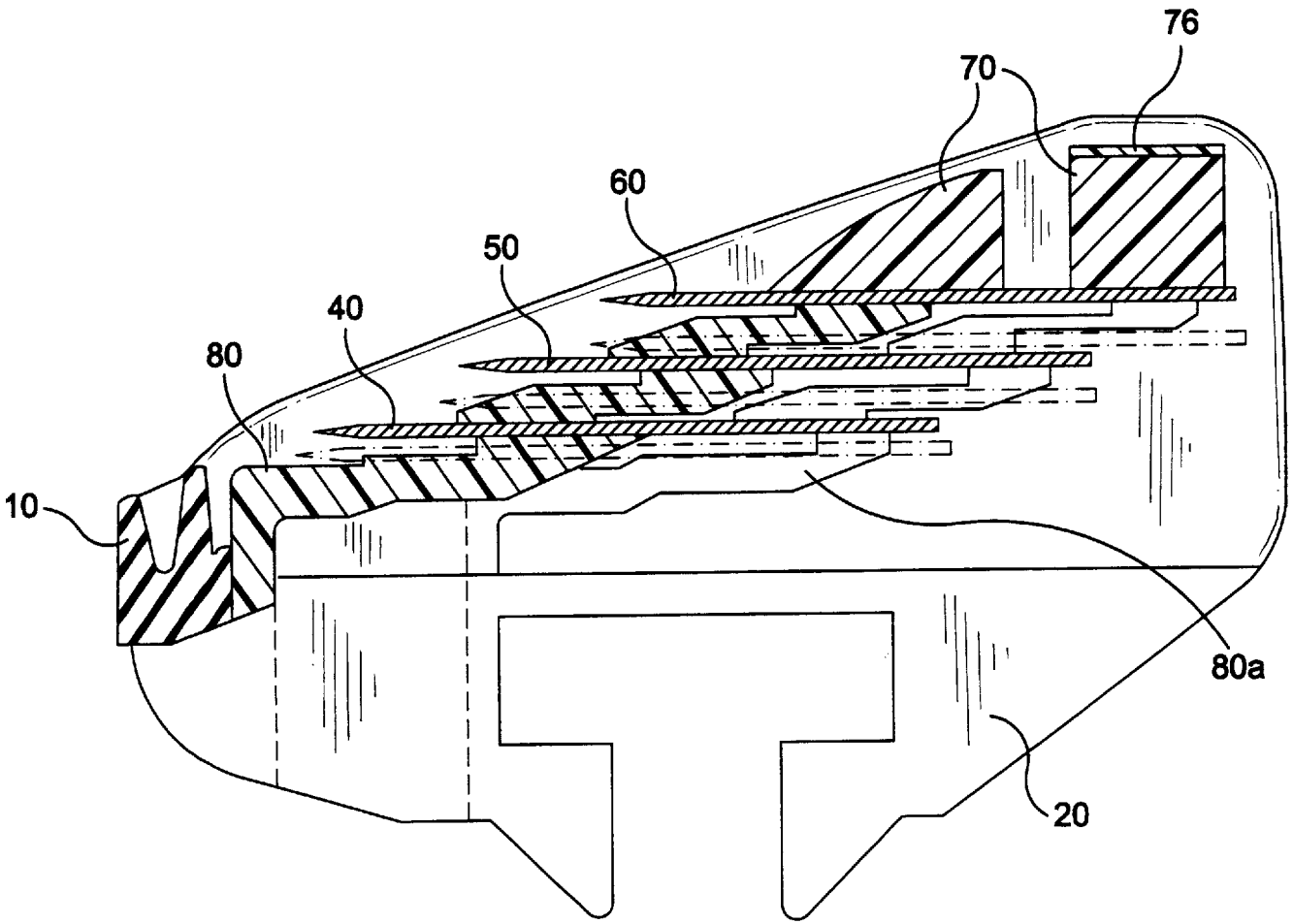
FIG. 4 is a cross-sectional view showing one possible position of the unbiased position and a biased position (in phantom) of the skin-engaging elements of one embodiment.

The dynamic aspects of the present invention are provided by the support members 80, 80*a* which have sufficient inherent resiliency to allow the blades and cap member 70 to move downwardly relative to side walls 30, i.e. toward base 20, in response to forces encountered during shaving. The support members 80, 80*a* also return these skin-engaging elements to their "normal" unbiased position when the shaving forces are removed. FIG. 4 illustrates the positions of the blades and cap member 70 when in a "normal" unbiased position in solid lines and one position of the blades and cap member 70 when acted upon forces encountered during shaving. The unique dynamics of the present invention can be appreciated best from FIG. 4 wherein it is also illustrated that the vertical spacing between the blades decreases and the entire skin-engaging package, including the blades and cap member 70, is effectively compressed toward base 20 in response to shaving forces.

Furthermore, since side walls 30 of this illustrated embodiment are fixed relative to base 20, the relative downward movement of the blades and cap 70 will tend to reduce the exposure of the portions of the cutting edges proximate side walls 30. Since the forward portion of the blades are not supported from underneath, the forward portions of the blades will tend to deflect downwardly even as the resilient supports 80, 80*a* are pivoting in a generally clockwise manner. Since the blades are secured to the resilient members, the rotation of the resilient support members 80, 80*a* would tend to rotate the blade edges into a more aggressive position. This increase in shaving angle is at least partially offset by the downward deflection of the cantilever, forward portion of the blades. From FIG. 4, it will also be appreciated that forces exerted on any one of the blades or cap member 70 will result in movement of each of the other movable, skin-engaging elements.

It will also be appreciated that in the illustrated embodiment, the upper skin-engaging elements will move more than the lower skin-engaging elements. For example, cap blade 60 will tend to move a greater distance than seat blade 40 due to their relative distances from the attachments between the support members 80, 80*a* and base member 20. It will also be appreciated from the present disclosure that because the upper skin engaging elements will tend to move a greater distance than the lower skin-engaging elements when acted upon by shaving forces, the change in the angle of the cap blade will be less than the change in the angle of the seat blade due to the distance and movement from the fulcrum point, i.e., where the resilient support 80 and/or 80*a* contacts the base.

Figure 5:
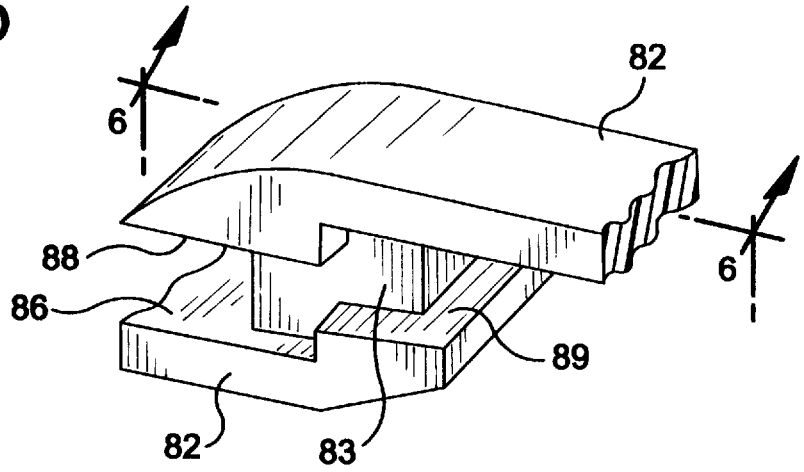
FIG. 5 is a partial, perspective view of a resilient support of a preferred embodiment of the present invention.
Figure 6:
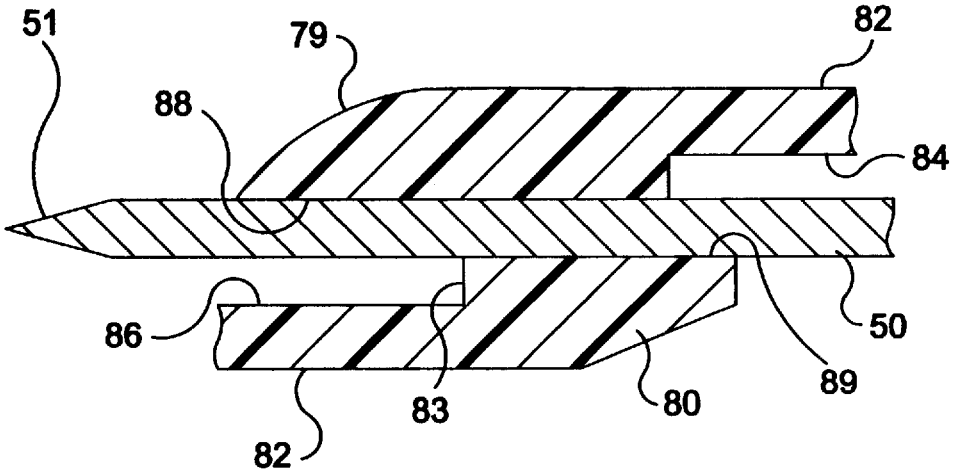
FIG. 6 is a cross-sectional view taken along line 6—6 of FIG. 5 with portions of a blade added.
Figure 7:
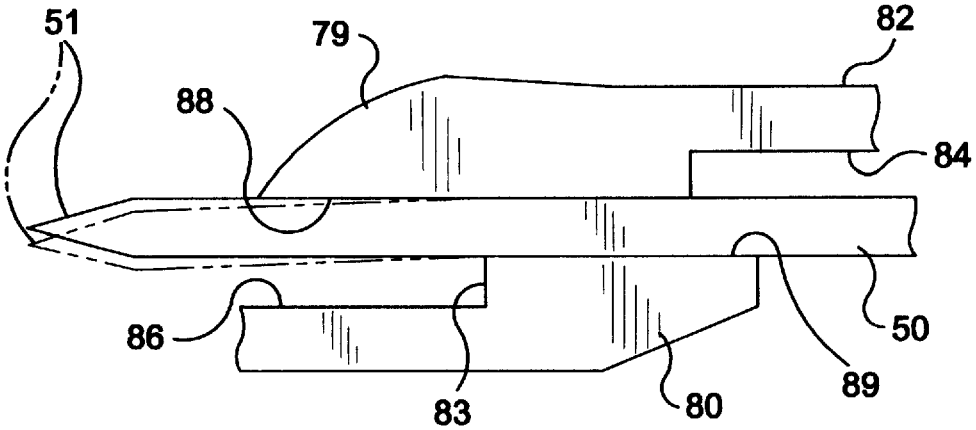
FIG. 7 is a side view of the portions of resilient support and blade shown in FIG. 6.

FIGS. 5–7 illustrate one preferred manner of connecting a resilient support member 80 to a blade 50. As shown, each of the illustrated support members 80, 80*a* comprise upper and lower generally horizontal sections 82 which are connected by generally vertical portions 83. The vertical portions 83 are rigidly connected to each of the blades. Upper, inner surface 84 of resilient support 80 is normally spaced from blade 50 as is lower, inner surface 86. Upper retention surface 88 and lower retention surface 89 extend laterally beyond vertical portion 83 above and below, respectively, blade 50. These retention surfaces of resilient support 80 contact the blade and tend to rotate the blade into a more aggressive shaving angle when the skin-engaging portions move in response to forces encountered during shaving. Simultaneously, in a preferred embodiment of the present invention, the forward portion of the blades which is cantilever, will tend to deflect downwardly as generally illustrated in FIG. 7. From the present description, those skilled in the art will appreciate that the blade thickness, material from which the blade(s) are formed as well as the distance from vertical portion 83 to the forward edge 51 of blade 50 will be important factors in determining the amount of deflection of blade 50.

From the present description, it will be appreciated that forces exerted on the movable skin-engaging elements during shaving will cause these movable elements to move along an arc. The angle and radius of the arc will be determined by the length of the effective radius which is related to the distance between the movable elements and the base of the resilient support member.

While the illustrated embodiment comprises three blades which are attached to resilient support 80 in the same manner, it is within the scope of the present invention to provide different connections. For example, the length of the cantilever portions of different blades can be different from blade to blade in order to achieve a desired amount of deflection. Furthermore, the thickness of the blades can be different, and the configurations and sizes of different portions of the resilient support 80, 80*a* can also be formed to allow greater resiliency at certain portions relative to other portions. In one preferred embodiment of the present invention, the blade deflection of the cantilevered forward portion of at least one blade is preferably up to about 0.010 inches during a typical shaving stroke.

According to alternative embodiments of the present invention, the length and positioning of the resilient support members 80, 80*a* can be modified to provide a different predetermined action such as unparallel blade movement, increasing the aggressiveness of the shaving geometry, or decreasing the aggressiveness of the shaving geometry in response to forces encountered during shaving. While in the illustrated embodiment the resilient support members 80, 80*a* have the same length and all angle upwardly and rearwardly, it is also possible to provide resilient supports having different lengths. For example, if the length of a rearward resilient support 80*a* is shorter than a forward resilient support 80, the shaving angle will tend to decrease in response to shaving forces. Furthermore, if the resilient support members 80, 80*a* are disposed in alignment, they can be formed with different lengths in order to dispose one or more of the blades in a relation other than parallel. For example, by forming the supports 80, 80*a* with different lengths, it is possible to move the vertical positioning of a single blade more on one side than on the other side. Moreover, it is also possible to vary the spring rate of one or more of the resilient supports 80, 80*a* to vary the angle of deflection for one or more of the blades during a shaving stroke.

It is also within the scope of the present invention to connect a resilient support 80 and/or 80*a* to another portion of the supporting structure of the razor head. Thus, while the resilient supports 80, 80*a* of the embodiment illustrated in FIGS. 1–4 are connected to the lower base of the support structure, it is also within the scope of the present invention to connect the resilient supports 80, 80*a* to a fixed cap member, rear walls or side walls. In each such instance, those skilled in the art will appreciate that the movement of the blades would not necessarily move in the same manner as the blades shown in FIGS. 1–4 in response to shaving forces. In this regard the blade movement would not necessarily be downward, i.e. toward the base.

Figure 8:
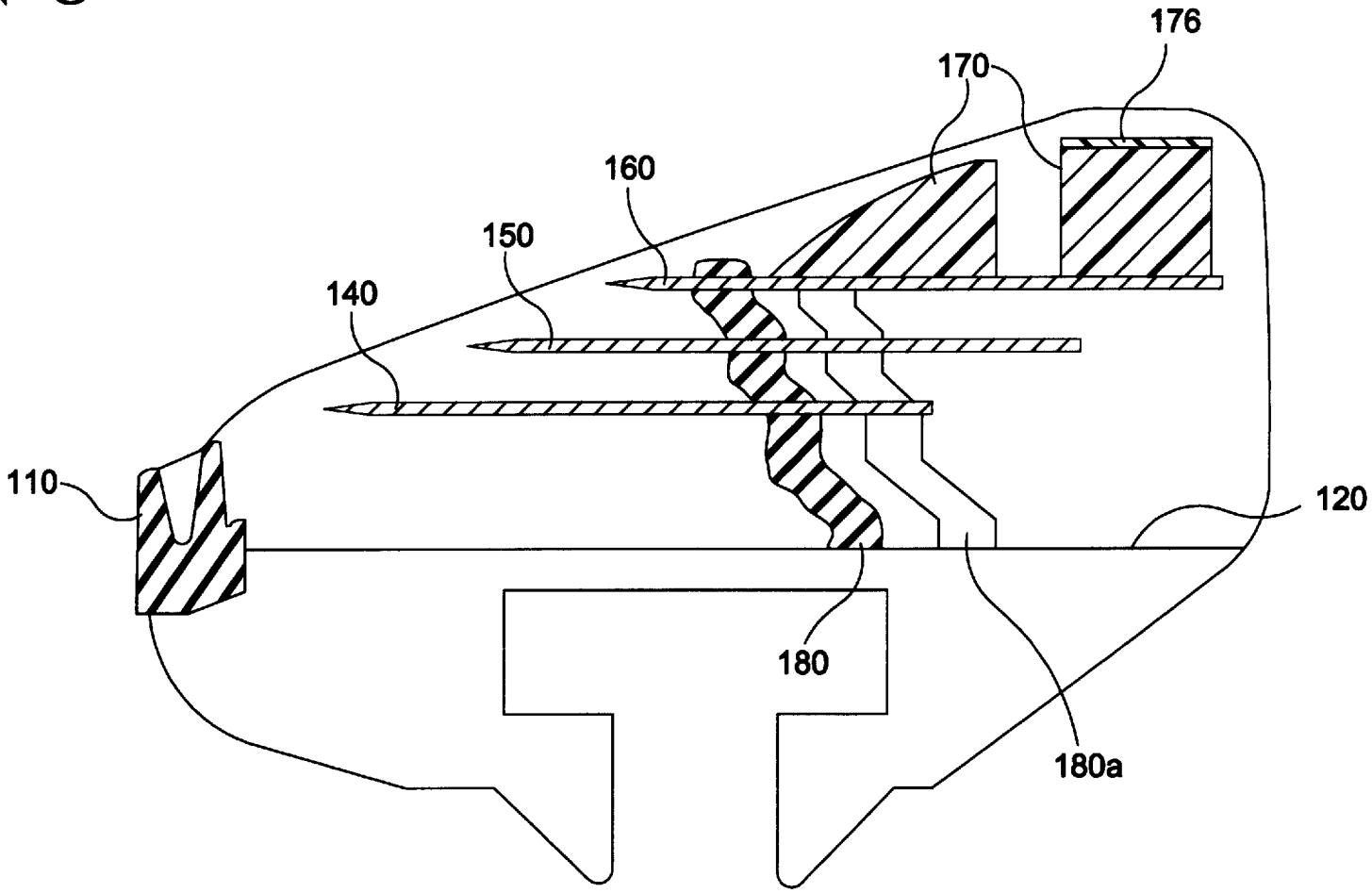
FIG. 8 is a cross-sectional view of an alternative embodiment of the present invention.

FIG. 8 illustrates an alternative embodiment of the present invention wherein resilient supports 180, 180*a* are angled forwardly from base 120. According to this alternative embodiment, the vertical distance between the blades will increase in response to forces exerted during shaving. Furthermore, according to this embodiment of the present invention, cap 170 is not connected to the support members, but is maintained fixed relative to the base 120.

According to an alternative embodiment of the present invention, two skin-engaging elements in the form of a blade and a cap member are resiliently supported by at least one resilient support member. Thus, the advantages of the present invention may also be realized with a single blade shaving system. It is also within the scope of the present invention to have one or more of the skin-engaging elements in the form of an unsharpened blade or to have the cap member comprise a plurality of segments designed to increase the versatility and/or resiliency of the cap member during a shaving stroke.

Furthermore, it will be appreciated that the movement of the skin-engaging members of the illustrated embodiment of the present invention move an amount proportionate to the force acting upon them. The present invention thereby advantageously provides precise coordination between the movement of each of the blades and the cap member 70 as a function of shaving forces applied.

Unlike the dynamic system disclosed in the Jacobson patent referenced above in which all movable skin-engaging elements move independently, the illustrated embodiments of the present invention control the shaving geometry, namely the shave angles and blade spans. The present invention thereby provides control over these dynamic parameters in a predictable manner so that a predetermined geometry will be maintained during the dynamics of shaving. Particularly, in the embodiment illustrated in FIGS. 1 to 7, shaving forces cause increasingly higher shave angles and increasingly greater spans which are designed to maintain desired closeness.

While the advantages of the present invention may be achieved with only a conventional, substantially rigid guard element 81 preceding the blade edges, the illustrated embodiment comprises a resilient skin-engaging material 10 having a higher coefficient of friction with wet skin than a rigid plastic of the type commonly used with disposable cartridges. The illustrated resilient material comprises a rubber-like texture and is connected to support base 20. The resilient material 10 is preferably connected to a rigid support base 20, formed for example, of polypropylene, in a sequential molding process. The resilient material 10 may comprise, for example, suitable corrosion-resistant, resilient materials such as Hercuprene 1000, 3000 series, Durometer 30 to 90 A scale available from J-Von, Leominster, Mass.; Kraton G series, Durometer 30 to 90 A scale available from GLS Corp. of Cary, Ill.; and Santoprene 2271 series, Durometer 30 to 90 A scale available from Monsanto, Colo. According to one preferred embodiment, a resilient material having a higher coefficient of friction with wet skin than a rigid plastic is also disposed on the upper, skin-engaging portions of sidewalls 30. As can be appreciated from the present disclosure, other portions of the razor may be provided with a resilient material to enhance the shaving process, e.g., resilient supports 80 and/or 80*a*.

According to a still further embodiment of the present invention, at least one of said blades further comprises a fencing element such as the type disclosed in U.S. Pat. Nos. 1,035,548, 3,263,330, 3,505,734, 3,750,285 and 4,122,006, which are hereby incorporated by reference.

While the illustrated embodiment comprises a plurality of blades and a movable cap supported by a plurality of resilient support members, advantages of the present invention may also be realized with a fixed cap member, movable side walls, and/or with less than the illustrated number of blades. Furthermore, while a plurality of resilient support members are preferred, it is also possible to utilize a single resilient support with one or more blades or to use one or more resilient supports within a single blade system.

Another preferred aspect of the present invention comprises the incorporation of a shaving aid on one or more of the skin-engaging surfaces of the shaving system.

A number of different materials have been suggested for use as shaving aids. The term "shaving aid," as used herein, refers equally either to the active ingredient combined within a delivery system, such as a water-insoluble microporous matrix structure or to the active ingredient alone. Previously suggested active ingredients include those disclosed in U.S. Pat. No. 4,170,821 to Booth, which is hereby incorporated by reference. A shaving aid may comprise one or various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum."

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph, which may exude from skin which has been irritated during shaving.

Alternatively, the shaving aid may comprise one or more of the shaving aids disclosed in U.S. Pat. No. 5,056,221 to Thoene, U.S. Pat. No. 4,044,120 to Rowsell et al., U.S. Pat. No. 5,095,619 to Davis et al., or Japanese Patent Application No. Hei 7 [1995]-24156 to Miyazaki, et al. which are also hereby incorporated by reference.

Other active ingredients may include various pigments, e.g., titanium dioxide, fragrances, aloe vera, flavoring agents, mineral oils, essential oils and other oils derived from plants. In addition to one or more active ingredients, the shaving aids of the present invention may also comprise other compounds or blends of compounds such as water-insoluble polymers such as polystyrene and polypropylene.

The razor heads of the present invention can be formed utilizing a wide range of engineering materials for both skin-engaging and non-skin-engaging elements, in order to create a variety of sensory stimulations that will effect the user's perception of the shave.

What is claimed is:

1. A razor head comprising:

a first support;

at least one resilient second support connected to said first support; and a plurality of skin-engaging elements rigidly connected to and movably supported by said second support, wherein at least one of said first and second supports comprises a material which is different from another support.

2. A razor head comprising:

a first support;

at least one resilient second support connected to said first support; and a plurality of skin-engaging elements rigidly connected to and movably supported by said second support, wherein at least one of said first and second supports comprises a different spring rate.

3. A razor head comprising:

a first support;

at least one resilient second support connected to said first support; and a plurality of skin-engaging elements rigidly connected to and movably supported by said second support, wherein at least three skin-engaging elements each comprising different materials.

4. A razor head comprising:

a first support;

at least one resilient second support connected to said first support; and a plurality of skin-engaging elements rigidly connected to and movably supported by said second support, wherein said second support and said first support comprise different materials.

5. A razor head according to any of claims 1, 2, 3 or 4, wherein said second support comprises at least one upper retention surface and at least one lower retention surface and wherein at least one of said skin engaging elements is disposed between said at least one upper retention surface and said at least one lower retention surface.

6. A razor head according to claim 5 wherein said at least one upper retention surface or said at least one lower retention surface is more forwardly disposed relative to the other.

7. A razor head according to claim 6 wherein at least one blade is located between said upper retention surface and said lower retention surface, said at least one blade having a forward edge and a rearward portion.

8. A razor head according to claim 7 wherein said forward edge of said at least one blade deflects in response to forces encountered during shaving.

9. A razor head according to claim 8 wherein when said at least one resilient support rotates in response to forces encountered during shaving said forward edge of said at least one blade deflects.

10. A razor head according to claim 7 wherein said forward edge of said at least one blade deflects in a cantilever fashion in response to forces encountered during shaving.

11. A razor head according to claim 5 further comprising a cap member supported by one of said plurality of skin engaging elements.

12. A razor head according to claim 11 wherein said cap member comprises a plurality of segments.

13. A razor head according to claim 12 wherein said segments comprise a forward segment and a rearward segment.

14. A razor head according to claim 5 wherein said second support is integrally formed with said first support.

15. A razor head according to claim 5 wherein said second support extends upwardly from said first support.

16. A razor head according to claim 15 wherein said second support also extends rearwardly from said first support.

17. A razor head according to claim 15 wherein said second support also extends forwardly from said first support.

18. A razor head according to claim 5 further comprising side walls extending upwardly from said first support.

19. A razor head according to claim 18 wherein said side walls comprise at least one resilient material.

20. A razor head according to claim 5 further comprising a resilient guard member.

21. A razor head according to claim 5 comprising at least three blades.

22. A razor head according to claim 5 comprising a plurality of support members wherein a length of a first resilient second support between a first skin-engaging element and said first support is different from a length of a second resilient second support between said first skin-engaging element and said first support.

23. A razor head according to claim 5 comprising a plurality of support members wherein a length of a first resilient second support between a first skin-engaging element and a second skin-engaging element is different from a length of a second resilient support between said first skin-engaging element and said second skin-engaging element.

24. A razor head according to claim 5 wherein at least one of said skin-engaging elements is an unsharpened blade.

25. A razor head according to claim 5 wherein at least one of said skin-engaging elements is a blade comprising a forward portion and a rearward portion, said forward portion of said blade deflects downwardly in response to forces encountered during shaving.

26. A razor head according to claim 25 wherein said at least one second support further comprises an upper retention surface and a lower retention surface, and wherein at least one blade is located between said upper retention surface and said lower retention surface, said at least one blade having a forward edge and a rearward portion.

27. A razor head according to claim 26 wherein one of said upper retention surface or said lower retention surface is forwardly disposed relative to the other.

28. A razor head according to claim 27 wherein said at least one resilient support rotates in response to forces encountered during shaving said forward edge of said at least one blade deflects downwardly.

29. A razor head according to claim 28 wherein said plurality of skin-engaging elements comprises two or more blades and wherein the angle of deflection of at least one of said two or more blades is different from the angle of deflection of at least another of said two or more blades.

30. A razor head according to claim 28 wherein the deflection of said at least one blade is up to about 0.010 inches.

31. A razor head according to claim 25 comprising a plurality of resilient second supports.

32. A razor head according to claim 25 wherein said at least one second support is integrally formed with said first support.

33. A razor head according to claim 25 further comprising side walls extending upwardly from said first support.

34. A razor head according to claim 25 comprising at least three blades.

35. A razor head according to claim 25 further comprising a cap member movably supported by one of said skin-engaging elements.

36. A razor head according to claim 35 wherein said cap member comprises a plurality of segments.

37. A razor head according to claim 5 wherein at least one of said skin-engaging elements is a blade comprising a forward portion and a rearward portion, said forward portion of said blade deflects in a cantilever fashion in response to forces encountered during shaving.

* * * * *